US012583662B2

(12) United States Patent
Ros et al.

(10) Patent No.: US 12,583,662 B2
(45) Date of Patent: Mar. 24, 2026

(54) TRANSPORT CONTAINER

(71) Applicant: REP IP AG, Zug (CH)

(72) Inventors: Nico Ros, Riehen (CH); Stefan Retzko, Zürich (CH)

(73) Assignee: REP IP AG, Zug (CH)

( * ) Notice: Subject to any disclaimer, the term of this patent is extended or adjusted under 35 U.S.C. 154(b) by 375 days.

(21) Appl. No.: 18/026,047

(22) PCT Filed: Sep. 14, 2021

(86) PCT No.: PCT/IB2021/058341
§ 371 (c)(1),
(2) Date: Mar. 13, 2023

(87) PCT Pub. No.: WO2022/054024
PCT Pub. Date: Mar. 17, 2022

(65) Prior Publication Data

US 2023/0382625 A1 Nov. 30, 2023

(30) Foreign Application Priority Data

Sep. 14, 2020 (AT) ..... A 210/2020

(51) Int. Cl.
*B65D 81/38* (2006.01)

(52) U.S. Cl.
CPC ..... *B65D 81/3823* (2013.01); *B65D 81/3818* (2013.01)

(58) Field of Classification Search
CPC . B65D 81/3818; B65D 81/3823; E04C 2/292; E04C 2/296; F25D 23/069; Y10S 220/918
See application file for complete search history.

(56) References Cited

U.S. PATENT DOCUMENTS 1,532,016 A 3/1925 Wright
2,119,438 A 5/1938 O'leary
(Continued)

FOREIGN PATENT DOCUMENTS

EP 0250005 A1 12/1987
EP 0990406 A2 4/2000
(Continued)

OTHER PUBLICATIONS

International Search Report and Written Opinion received in PCT/IB2021/058341 dated Dec. 2, 2021, pp. 16.
(Continued)

*Primary Examiner* — Andrew T Kirsch
(74) *Attorney, Agent, or Firm* — Liang & Hennessey LLP; Brian Hennessey

(57) ABSTRACT

In a transport container for transporting temperature-sensitive goods, having a container wall arrangement which surrounds an interior space for receiving the goods and has a plurality of walls which adjoin one another at an angle, the container wall arrangement being self-supporting and having an opening for loading and unloading the interior space, which opening can be closed by means of a separate wall element and wherein the container wall arrangement encloses the interior space on all sides with the exception of the opening, the container wall arrangement comprises an outer wall, an inner wall spaced therefrom and a vacuum chamber formed between the outer and inner walls, wherein the vacuum chamber is formed as a continuous vacuum chamber surrounding the interior space on all sides with the exception of the opening.

21 Claims, 5 Drawing Sheets

(56) References Cited

U.S. PATENT DOCUMENTS

| | | | | |
|---|---|---|---|---|
| 2,702,458 | A | 2/1955 | Del Mar | |
| 3,009,601 | A | 11/1961 | Matsch | |
| 5,157,893 | A * | 10/1992 | Benson | B64G 1/22 52/789.1 |
| 2015/0059277 | A1* | 3/2015 | Collins | E04D 3/351 428/69 |
| 2015/0166244 | A1* | 6/2015 | Wood | B31B 50/74 220/592.25 |
| 2017/0253416 | A1* | 9/2017 | Reid | B32B 1/00 |
| 2020/0247083 | A1 | 8/2020 | Ros | |

FOREIGN PATENT DOCUMENTS

| | | | |
|---|---|---|---|
| EP | 3233668 | A1 | 10/2017 |
| WO | 2017207974 | A1 | 12/2017 |
| WO | 2019229646 | A1 | 12/2019 |

OTHER PUBLICATIONS

International Preliminary Report received in PCT/IB2021/058341 dated Jul. 15, 2022, pp. 13.

* cited by examiner

TRANSPORT CONTAINER

CROSS-REFERENCE TO RELATED APPLICATIONS

The present application is a national phase application of PCT Application No. PCT/IB2021/058341, filed Sep. 14, 2021, entitled "TRANSPORT CONTAINER", which claims the benefit of Austrian Patent Application No. A 210/2020, filed Sep. 14, 2020, each of which is incorporated by reference in its entirety.

BACKGROUND OF THE INVENTION

1. Field of the Invention

The invention relates to a transport container for transporting temperature-sensitive goods, having a container wall arrangement surrounding an interior space for receiving the goods and having a plurality of walls adjoining one another at an angle, the container wall arrangement being self-supporting and having an opening for loading and unloading the interior space, which opening can be closed by means of a separate wall element, and the container wall arrangement enclosing the interior space on all sides with the exception of the opening.

2. Description of the Related Art

When transporting temperature-sensitive goods, such as pharmaceuticals, over periods of several hours or days, specified temperature ranges must be observed during storage and transport in order to ensure the usability and safety of the goods. For various drugs, temperature ranges from 2 to 25° C., in particular 2 to 8° C. or 15 to 25° C., are specified as storage and transport conditions.

To ensure that the desired temperature range of the transported goods is permanently and verifiably maintained during transport, transport containers, e.g. air freight containers, with special insulation properties are used. The technical implementation of temperature-controlled transport containers is usually carried out with active or passive cooling systems in combination with insulation of the outer shell. The quality of the insulation plays a major role in the performance of the container, especially in passive cooling systems.

A conventional design of insulation of temperature-controlled transport containers involves the use of insulation materials in layers, such as polystyrene, polyisocyanurate (PIR), extruded polystyrene (XPS). However, the insulating performance of these materials is limited and thick wall assemblies are required to achieve the desired performance of the tank. This leads to a reduction in the usable interior space and an increase in the container weight. Both are disadvantageous, especially in the case of air transport, both from a financial and an ecological point of view.

Another embodiment of temperature-controlled transport containers includes a wall structure with plate-shaped vacuum panels. They generally consist of a porous core material that serves, among other things, as a support body for the vacuum present inside the vacuum panel, and a high-density envelope that prevents gas from entering the vacuum panel. However, vacuum panels are susceptible to damage, which can drastically reduce insulation performance. Therefore, additional wall structures are needed to protect the vacuum panels from external influences, resulting in a detrimental increase in weight. Additional components are also needed at the edges of the vacuum panels to connect the individual container walls. This creates thermal bridges, which reduce the effective insulation performance, and increase the overall weight of the container.

SUMMARY OF THE INVENTION

The present invention therefore aims to provide a wall-integrated vacuum insulation for temperature-controlled transport containers. The outer walls of the container should be flat walls so that the available space can be optimally utilized during air transport. Insulation performance shall be significantly better than current transport containers of the same size. This means that for a container size of e.g. 1×1.2×1.2 m, the equivalent thermal conductivity (including all thermal bridges) of the insulation should be in the range <5 mW/(m·K). Since the transport container is preferably intended for air transport, the weight of the insulation plays a key role. The design should therefore be optimized with regard to the total container weight. At the same time, the stability of the container should be ensured without the need for additional structural components.

To solve this problem, the invention essentially provides, in a transport container of the type mentioned at the beginning, that the container wall arrangement has an outer wall, an inner wall spaced therefrom, and a vacuum chamber formed between the outer and inner walls, the vacuum chamber being designed as a continuous vacuum chamber surrounding the interior space on all sides with the exception of the opening. The container wall arrangement is thus designed as a double-walled vacuum container which surrounds the interior space on all sides with the exception of the container opening. Therefore, unlike the use of conventional vacuum panels, the insulation does not consist of individual vacuum elements that have to be assembled into a container, but includes in one part all sides of the transport container except for the opening. The transport container or the container wall arrangement can be designed in various geometric shapes, in which a plurality of walls adjoining each other at an angle are provided. Preferably, the container is a cuboid transport container having six walls, of which the wall arrangement according to the invention forms five walls, and a separate wall element is provided to close the opening of the interior space formed by the wall arrangement. Preferably, the wall arrangement thus forms the ceiling, the floor, the side walls and the rear wall of the transport container.

According to the invention, a continuous vacuum chamber is formed between the inner and outer walls of the container wall arrangement, which surrounds the interior space on all sides with the exception of the opening. This means that the interior space is not surrounded by several separate vacuum chambers, as is the case with a conventional design in which the ceiling, floor, side walls and rear wall are each formed by a separate vacuum panel and in which a thermal bridge is created at the junction between adjacent panels.

The double-walled container wall arrangement is self-supporting, so no separate structural elements are required to ensure the stability of the container.

Preferably, the outer and inner walls are made of a metal sheet, in particular stainless steel, aluminum or titanium, and preferably have a thickness of 0.01 to 1 mm. This ensures the required stability on the one hand and the gas-tight design of the walls on the other. Preferably, the outer wall and the inner wall can each be assembled from a plurality of planar sheets, and the connecting regions can be joined together in a gas-tight manner by welds.

Further, the vacuum chamber is preferably closed by a connecting collar extending along the edge of the opening and connected to the outer and inner walls.

Preferably, the outer and inner walls of the container wall arrangement are flat.

The transport container according to the invention is preferably designed as an air freight container and therefore preferably has external dimensions of at least 0.4×0.4×0.4 m, preferably 0.4×0.4×0.4 m to 1.6×1.6×1.6 m, preferably 1.0×1.0×1.0 m to 1.6×1.6×1.6 m.

The term "vacuum chamber" means that the space between the inner and outer walls of the container wall arrangement is evacuated, thereby providing thermal insulation by reducing or eliminating heat conduction of the gas molecules through the vacuum. Preferably, the air pressure in the vacuum chamber is 0.001-0.1 mbar.

In order to be able to withstand the compressive forces of the surrounding air without having to make the outer and inner walls excessively thick, the outer wall and the inner wall are preferably connected by a plurality of spacers, which preferably have a thermal conductivity of <2 W/(m·K), more preferably <1 W/(m·K), more preferably <0.5 W/(m·K), more preferably <0.35 W/(m·K) and particularly preferably <0.2 W/(m·K), and are preferably made of a plastic, such as e.g. polyetheretherketone or aramide, a ceramic material or glass. The spacers ensure the desired distance between the outer and inner walls so that the intervening cavity, i.e. the vacuum chamber, remains. Since the spacers form thermal bridges, it is advantageous to make them from a material with the lowest possible thermal conductivity.

In order to further minimize heat transfer between the outer and inner sides, it is preferred that the spacers are designed as the thinnest possible elements. In particular, the spacers can be designed as pin-shaped elements, which preferably have a round, in particular circular, cross-section and preferably have a diameter of 1-5 mm at the thinnest point.

Preferably, the normal distance between the outer and inner walls is 10-40 mm, preferably 10-20 mm.

This results in a design in which the length of the spacers is significantly greater than their diameter, which minimizes heat conduction.

Preferably, the spacers are evenly spaced 10-100 mm apart.

To avoid point loading of the outer and inner walls at the contact point of the spacers, a preferred embodiment of the invention provides that the spacers contact the outer and inner walls via at least one pressure distribution element each. Due to the distribution of pressure over a larger wall area, the outer and inner walls can be designed with a reduced wall thickness, which is accompanied by a reduction in weight, whereby in the case of a stainless steel design a wall thickness of preferably 0.1-1 mm is sufficient and in the case of an aluminum design a wall thickness of preferably 0.5-5 mm is sufficient. Without pressure distribution elements, there is a risk that the spacers will puncture the outer and inner walls under the pressure of the ambient air at such low wall thicknesses.

Preferably, the at least one pressure distribution element is provided as a support plate, the support plate preferably forming a common support for a plurality of aligned spacers. In this case, the pressure distribution elements can be designed as elongated plate-shaped elements, which have a thickness of 0.3 to 5 mm and a width of 5 to 30 mm, for example, and are preferably made of aluminum, stainless steel or plastic. In this case, a plurality of such elongated plate-shaped elements may be arranged in parallel and spaced apart from each other in accordance with the grid arrangement of the spacers.

Alternatively, the at least one pressure distribution element may be formed by a widened end of the spacer, the widened end preferably being integral with the spacer and therefore formed of the same material as the spacer. The widened end may have a mushroom shape. The wider end can have a height of 2-5 mm and a diameter of 6-50 mm, for example, and thus introduce the forces evenly into the outer or inner wall of the container wall arrangement.

In order to further increase the thermal insulation performance of the container wall arrangement, a preferred further development provides that a plurality of spaced-apart insulation foils are arranged in the vacuum chamber, the foil plane of which is substantially parallel to the plane of the outer and inner walls. In particular, the insulation foils are in stacked form, with a foil stack preferably being arranged in each wall of the wall arrangement and extending substantially over the entire wall. Preferably, the insulation foils are arranged so that they surround the interior space on all sides except for the opening.

Preferably, the insulation foils are arranged in such a way that a gap (protective space) remains between the inner surface of the outer or inner wall facing the vacuum chamber and the foil stack in each case, so that the foil stack is not compressed by any deformation of the walls. In addition, the distance provides space for constructive stabilization of the spacers and facilitates vacuuming.

A further preferred design provides that the insulation foils are held at a distance from one another by flat spacer elements, the flat spacer elements preferably being formed by a textile sheet material, in particular in the form of a polyester nonwoven.

In particular, the insulation foils can be designed as metal-coated or metal-vaporized plastic foils. Such insulation foils are also called superinsulation foils. For example, the metal coating is made of aluminum.

The functioning of the insulation foils results from the following physical relationship: The thermal conductivity of air depends on both the pressure and the width of the air gap to be bridged. This can be explained by molecular thermodynamics and occurs when the gap width is of the same order of magnitude as the mean free path length of the air molecules. The mean free path of air molecules is inversely proportional to the air pressure, i.e. at very low air pressures or very small gap widths it is relatively large. The relationship is described by the Knudsen number, which is the ratio between the mean free path length and the characteristic length of a flow. When the Knudsen number is above 10, we speak of free molecular motion and the thermal conductivity of the air is very low. In addition, convective heat conduction effects can be neglected.

A combination of low air pressure and small gap widths is used in the context of the invention to achieve very low thermal conductivity of air (preferably <1 mW/(m·K)). The gap widths here are the distances between the individual layers of the insulation foil and are preferably in the range between 0.1 and 5 mm.

The foil stack preferably consists of 2-50 layers of metal-vaporized, in particular aluminum-vaporized, foils and 2-50 layers of foil spacer (e.g. a polyester spunbonded fabric). In addition to reducing the gap width and thus preventing heat conduction in the air, the insulating foil greatly reduces thermal radiation. On the one hand, this is achieved by the low emissivity of the metal coating, especially the aluminum coating. Secondly, the individual opposing foil layers are each in thermal equilibrium and emit or absorb approximately the same amount of energy. Solid-state heat conduction in the foil spacers is preferably minimized by having the foil spacers, such as a polyester nonwoven, loosely sandwiched between the foils, with actual contact occurring only at a few points. In the case of using a polyester nonwoven, the advantage is used that polyester is a weak heat-conducting material, the thread thickness of the nonwoven is small and a direct connection between opposite insulation foils in the chaotic nonwoven structure occurs only very rarely.

As mentioned above, the vacuum chamber is preferably closed by a connecting collar extending along the edge of the opening and connected to the outer and inner walls. The connecting collar should be as gas-tight as possible and be able to be connected to the outer and inner wall in a gas-tight manner. Suitable materials for the connecting collar include stainless steel or titanium.

Preferably, the connecting collar is made of the same material, in particular the same metal, as the inner and outer walls and is preferably welded to them.

Alternatively, the connecting collar may be made of a different metal than the inner and outer walls and may be welded to them, preferably by friction welding.

Since the thermal conductivity of the connecting collar is relatively high in the case of metal, a large part of the heat input into the transport container occurs via the connecting collar (thermal bridge). Design optimization of the connecting collar as well as the surrounding structure is therefore advantageous to increase the overall performance of the insulation. Important parameters are the length of the connection between the outer and inner wall and the cross-sectional area of the connecting collar.

According to a preferred design, in order to increase the path length between the outer and inner walls, the connecting collar is provided to extend obliquely (i.e. at an angle different from 90°) relative to the plane of the outer wall, in particular at an angle of 10-80°.

Another way to increase the path length is for the connecting collar to have a corrugated or kinked path going from the outer wall to the inner wall.

The overall performance of the insulation of the transport container naturally depends also on the thermal insulation properties of the element closing the opening of the interior space. Preferably, the transport container further comprises a separate wall element with which the opening is closed, wherein the separate wall element preferably comprises an outer wall and an inner wall spaced therefrom, between which a vacuum chamber is formed.

The separate wall element can have the same wall structure as the container wall arrangement. The separate wall element can therefore also contain a plurality of insulation foils spaced one above the other in its vacuum chamber.

The separate wall element can, for example, be designed as a door and therefore be attached to the transport container by means of a hinge.

As mentioned earlier, much of the heat enters the transport container through the connecting collar. It is therefore important to prevent direct heat transfer to the transported goods. Latent heat storage systems are capable of absorbing large amounts of heat through a phase change from solid to liquid. A preferred further development of the invention therefore provides that a layer of a phase change material is arranged on the side of the separate wall element facing the interior space, which layer extends at least along the edge region of the opening. The phase change material therefore absorbs the heat introduced via the connecting collar.

Preferably, the phase change material covers the entire surface of the separate wall element facing the interior space, wherein an energy distribution layer made of a material with a thermal conductivity of >100 W/(m·K), in particular >200 W/(m·K), can be arranged between the separate wall element and the phase change material. The more uniform the phase change of the phase change material, the more efficiently the introduced heat can be absorbed. Therefore, the phase change material can be combined with an energy distribution layer or plates of highly thermally conductive materials (e.g., aluminum or carbon nanotubes). In this case, the heat introduced locally via the connecting collar is distributed over a larger area of the energy distribution layer and absorbed uniformly by the latent heat storage material.

In addition to placing the phase change material on the separate wall element or door, a phase change material can also be used on the container wall arrangement, i.e. on the side walls, the floor, the ceiling as well as the rear wall. In addition, energy distribution layers can also be used here to distribute heat to the phase change material in the rear areas of the transport container. It is important to ensure sufficient distance to the connecting collar to avoid a direct thermal bridge. In particular, a preferred embodiment of the invention in this context provides that a layer of a phase change material is arranged on the side of the inner wall of the container wall arrangement facing the interior space, which surrounds the interior space on all sides with the exception of the opening, and that an energy distribution layer of a material with a thermal conductivity of >100 W/(m·K), in particular >200 W/(m·K), is preferably arranged between the inner wall of the container wall arrangement and the phase change material.

Preferably, the at least one energy distribution layer consists at least partially, in particular entirely, of aluminum, copper, or carbon nanotubes.

With a view to optimizing the weight of the transport container as far as possible, the at least one energy distribution layer is preferably relatively thin and in particular has a thickness of less than 2 mm.

Preferably, a phase change material is selected with a phase transition temperature that is matched to the temperature range desired in the interior space of the transport container so that the desired temperature range can be kept as stable as possible and independent of the outside temperature. Preferably, the phase transition temperature is in the range of 2° C.-15° C.

The phase-change material layer preferably comprises phase-change material elements designed as two-dimensional chemical latent heat storages, whereby conventional designs can be used with regard to the medium forming the latent heat storage. Preferred media for latent heat storage are paraffines and salt mixtures.

To further improve the insulation properties, an insulating layer not designed as vacuum insulation can be arranged on the outside of the container wall arrangement. By means of the insulating layer, the energy flow in the radial direction towards the interior space of the transport container is further reduced. The insulating layer preferably surrounds the interior space of the transport container on all sides. The insulating layer can have a thermal conductivity of <0.02 W/(m·K), preferably <0.012 W/(m·K).

Alternatively, the outer wall of the container wall arrangement forms the outer surface of the transport container so that no other layers or elements are attached to the outer wall.

In order to be able to detect any damage to the transport container, it is preferably provided that at least one temperature sensor is arranged in the interior space, and preferably at least one temperature sensor on each side of the transport container. Based on the measured values of the at least one temperature sensor, the performance of the insulation can be continuously monitored. In addition, a sensor can be fitted which measures the ambient temperature, whereby the insulation performance of the container wall arrangement can be continuously calculated from the temperature difference curve of the at least one temperature sensor arranged in the interior space and the external temperature sensor. This data can be continuously transmitted to a central database using wireless data transmission means so that the functionality of the transport container can be globally monitored and ensured.

BRIEF DESCRIPTION OF THE DRAWINGS

The invention is explained in more detail below with reference to exemplary embodiments shown schematically in the drawing. Therein.

DETAILED DESCRIPTION

Figure 1:
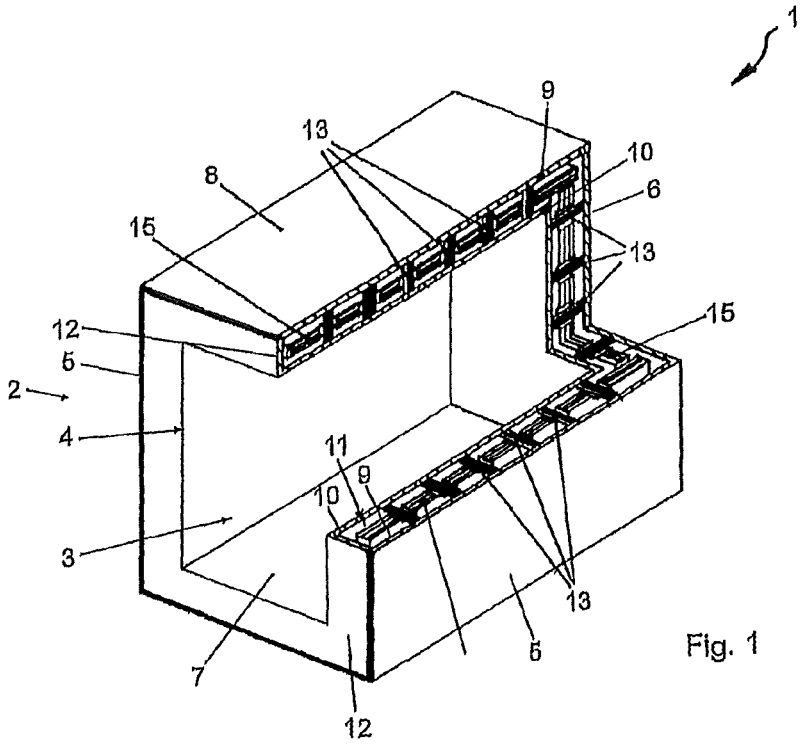
FIG. 1 shows a perspective view of a cuboid transport container according to the invention.

FIG. 1 shows a cuboid transport container 1 whose container wall arrangement 2 surrounds an interior space 3 on all sides except for an opening 4. The container wall arrangement 2 includes two side walls 5, a back wall 6, a bottom 7 and a ceiling 8. The container wall arrangement 2 is designed as a double-walled vacuum container and comprises an outer wall 9 and an inner wall 10, which run parallel and at a distance from each other. The wall structure can be seen in FIG. 1 in the area shown broken open and in the detailed view shown in FIG. 2.

The outer wall 9 consists of five plate-shaped outer wall sections, one each for the two side walls 5, the rear wall 6, the floor 7 and the ceiling 8. The wall sections can be bent from a single flat piece of material, such as a metal sheet, and joined together along the abutting edges, in particular welded. The wall sections may also consist of separate flat pieces of material, such as separate sheets, so that a joint, in particular a weld, is required at each edge.

Similarly, the inner wall 10 consists of five plate-shaped outer wall sections, one for each of the two side walls 5, the rear wall 6, the floor 7 and the ceiling 8. Here, too, the wall sections can be bent from a single flat piece of material, such as a metal sheet, and joined together along the abutting edges, in particular welded. The wall sections may also consist of separate flat pieces of material, such as separate sheets, so that a joint, in particular a weld, is required at each edge.

The outer wall 9 and the inner wall 10 thus form two separate shells between which a continuous vacuum chamber 11 is formed. To close the vacuum chamber 11, the outer wall 9 and the inner wall 10 are connected at the front, i.e. along the opening 4, by means of a connecting collar 12. The connecting collar 12 can also consist of a flat piece of material, in particular a metal sheet, and be welded to the outer wall 9 and the inner wall 10 at the abutting edges.

Figure 2:
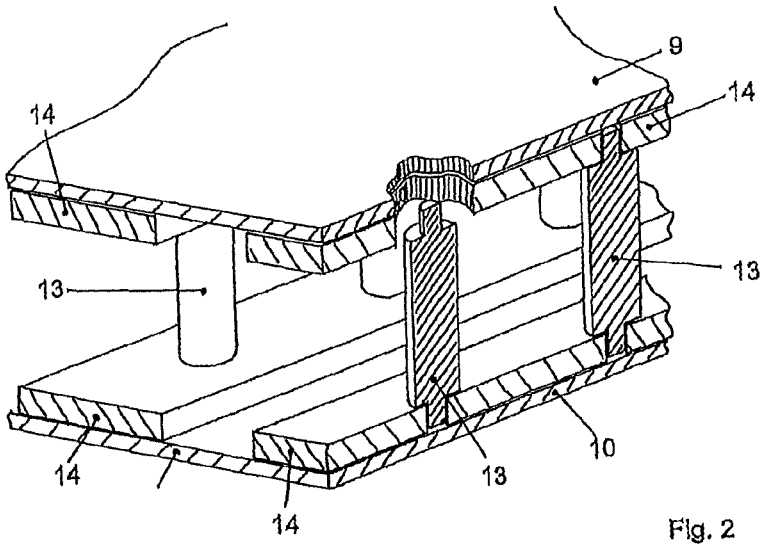
FIG. 2 shows a detailed view of the structure of the container wall arrangement.

In order to keep the outer wall 9 and the inner wall 10 at the specified distance, several spacers 13 extend between the outer wall 9 and the inner wall 10, which are designed as pins in the embodiment according to FIG. 2. The spacers 13 must be able to absorb the compressive forces that occur and transmit them as evenly as possible to the walls of the vacuum container. In addition, the solid-state heat conduction through the spacers 13 must be minimized, otherwise the insulation performance would be degraded. In addition, the total weight of the structure plays an important role and must also be minimized. To meet these requirements, a large number of relatively thin spacers 13 are provided.

The spacers 13 contact the outer wall 9 and the inner wall 10 with the interposition of pressure distribution elements 14, which are designed as flat webs. The spacers 13 are fastened with connecting pieces in holes along the webs 14.

In FIG. 1, it can be seen that stacks 15 of insulation foils extending over the entire wall surface are arranged in the vacuum chamber 11. To insert the insulation foils, the spacers 13 can either be designed to fit into each other or the insulation foil can be provided with corresponding slots.

Figure 3:
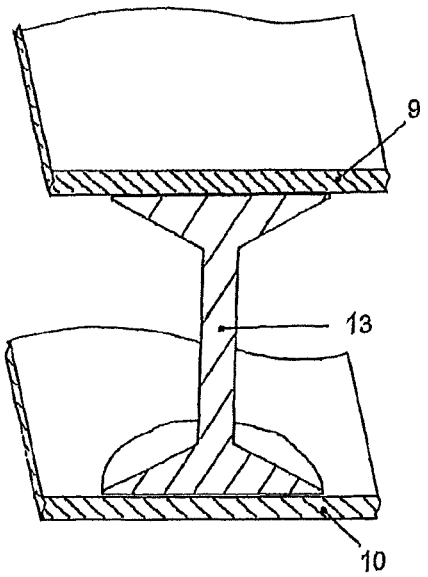
FIG. 3 shows a detailed view of an embodiment of the spacers.

FIG. 3 shows an alternative design of the spacers 13. The force transmission between the spacers 13 to the outer wall 9 and to the inner wall 10 is achieved via a mushroom shape of the spacers 13 on both sides. The mushrooms are part of the spacers 13 and are made, for example, of a low heat-conducting plastic (e.g. PEEK or Kevlar). The smallest diameter of the spacers 12 is preferably 1-5 mm, which is much smaller than the length, further reducing the solid-state heat conduction. The mushrooms preferably have a height of 2-5 mm each and a diameter of 6-50 mm at their support and uniformly transfer the occurring forces into the walls.

Figure 4:
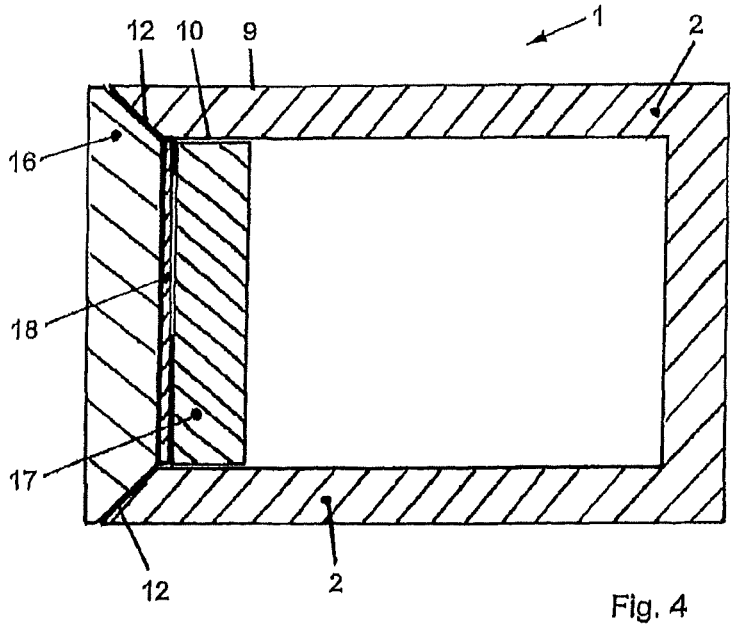
FIG. 4 shows a sectional view of a transport container with closed opening.

In FIG. 4, the structure of the transport container 1 is shown schematically in a sectional view. The vacuum container is combined with a separate wall element 16 for insulating the front, so that the transport container 1 is closed. Since the greatest heat input is expected in the area of the connecting collar 12, in this variant a latent heat storage 17 is only installed at the front to absorb the heat and keep it away from the transported goods. A high thermal conductivity energy distribution plate 18 between the door insulation and the latent heat storage 17 provides uniform distribution of heat to prevent local melting of the phase change material of the latent heat storage 17.

Figure 5:
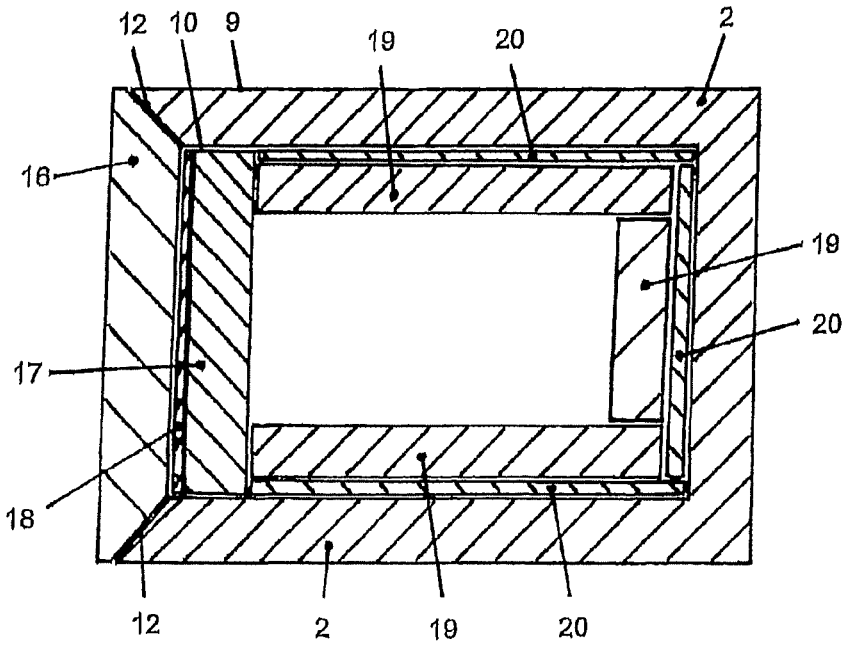
FIG. 5 shows an alternative embodiment of the transport container according to FIG. 4.

FIG. 5 shows an alternative design of the transport container 1 schematically in a sectional view. The vacuum container 1 is combined with a separate wall element 16 to insulate the front so that the transport container is closed. Again, the greatest heat input is expected in the area of the connecting collar 12. In addition to the front latent heat storage 17, in this variant latent heat accumulators 19 are also used on the side walls 5, the rear wall 6, the floor 7 and the ceiling 8. In addition, high thermal conductivity energy distribution plates 20 are used to distribute heat to latent heat storages 19 in the rear regions of the transport container 1. It is important to ensure sufficient distance to the connecting collar 12 to avoid a direct thermal bridge.

Figure 6:
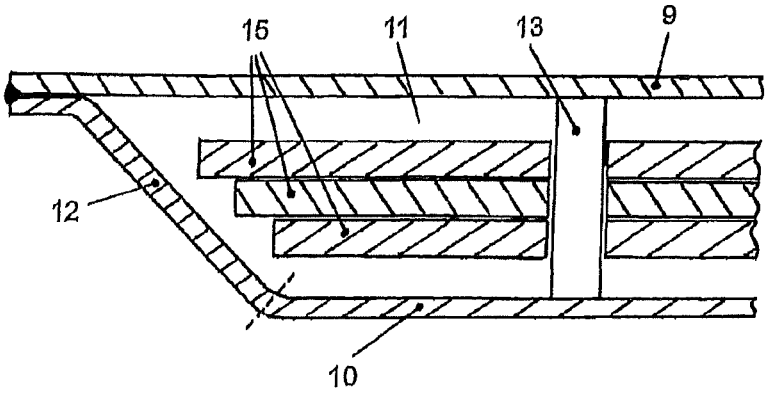
FIG. 6 shows a detail view of a wall design in the area of the connecting collar.

FIG. 6 shows a detail of the connecting collar 12 in section, with the connecting collar 12 extending at an oblique angle to the outer wall 9 and the inner wall 10 so that the path length between the outer wall 9 and the inner wall 10 is increased. In this embodiment, the outer wall 9 and the inner wall 10 as well as the connecting collar 12 may be made of stainless steel (e.g. V2A) with a thickness of 0.01 to 1 mm, the sheets being welded at the front.

Figure 7:
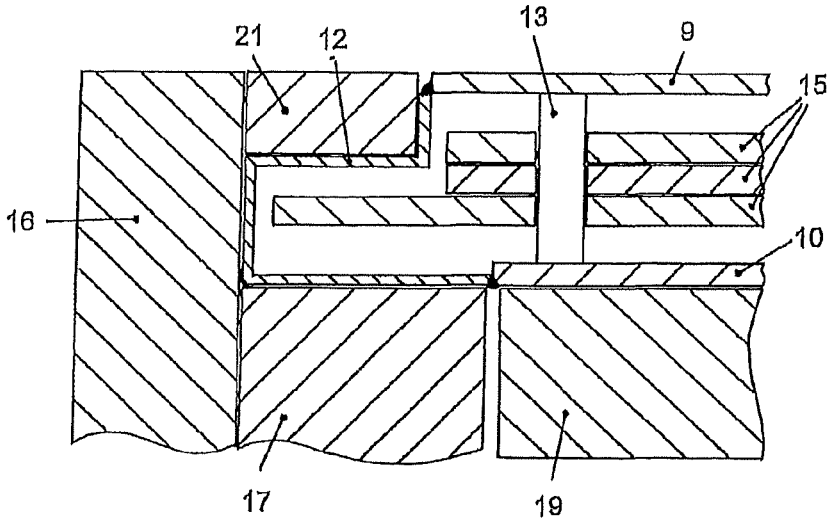
FIG. 7 shows a detail view of an alternative wall design in the area of the connecting collar and FIG. 8 shows a detail of the connecting collar 12 in section.

In the alternative embodiment shown in FIG. 7, the outer wall 9 and the inner wall 10 are made of aluminum with a thickness of, for example, 0.5-5 mm. The connecting collar 12 is made of stainless steel (e.g. V2A) with a thickness of e.g. 0.1 to 1 mm. The different materials are welded together by friction welding or by coating the mating parts with a weldable material. The connecting collar 12 is designed as a labyrinth so that the path length between the outer wall 9 and the inner wall 10 is increased, thus reducing the heat input. In addition, the connecting collar 12 is insulated from the outside with a thermal insulation 21. The beginning of the aluminum inner wall 10 is offset to the rear to reduce the heat input into the rear area of the transport container 1.

Figure 8:
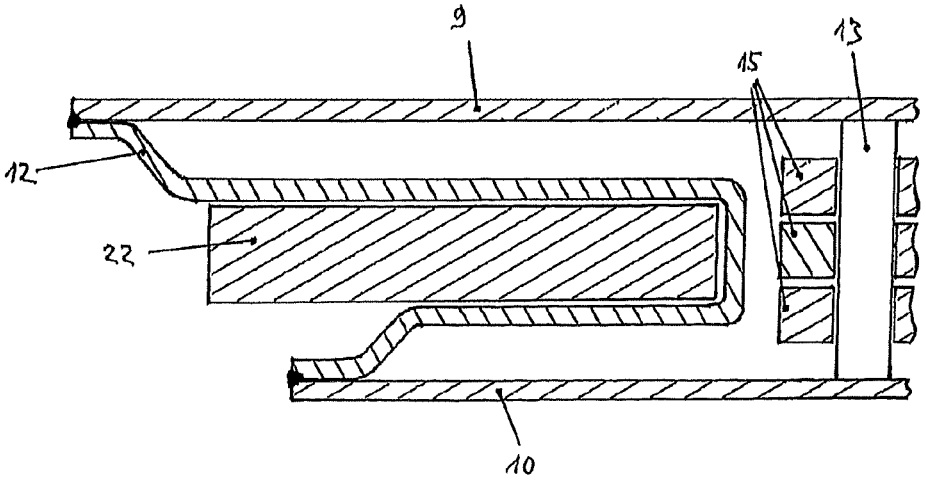

FIG. 8 shows an alternative embodiment of the connecting collar 12 in section, wherein the connecting collar 12 extends in an asymmetrical U-shape between the outer wall 9 and the inner wall 10, so that the path length between the outer wall 9 and the inner wall 10 is increased. In addition, the connecting collar 12 is insulated with a thermal insulation 22 inserted in the U-shape. In this embodiment, the outer wall 9 and the inner wall 10 as well as the connecting collar 12 may be made of stainless steel (e.g. V2A) with a thickness of 0.01 to 1 mm, the sheets being welded at the front.

Another way to increase the path length between the outer and inner walls of the vacuum vessel is to make the connecting collar in a corrugated shape.

The overall insulation performance of the transport container according to the invention results from an interconnection of the individual thermal resistors. The following elements are considered:

- Door insulation
- Thermal radiation
- Vacuum container:
  - Outer and inner shell
  - Spacers incl. stiffening structures
  - Air in the surrounding shelter
  - Air between the individual layers of the superinsulation foil
  - Foil spacers of the super insulation (e.g. polyester fleece)
  - Superinsulation foil layers With the resulting total thermal resistance, the surface area of the container and the insulation thickness, an equivalent thermal conductivity ($\lambda_{äqu}$) can be calculated. The present invention achieves an equivalent thermal conductivity of $\lambda_{äqu}$=4 mW/(m·K) to 0.5 mW/(m·K) for a transport container size of about 1×1.2×1.2. For comparison, conventional vacuum panels have a thermal conductivity of about 5 mW/(m·K). Thus, the present invention provides significantly better insulating performance.

Another advantage is the low weight. Since vacuum panels consist of individual elements, additional structural parts are needed to ensure the stability of the transport container. This means additional weight. With the present invention, the transport container is stabilized by the vacuum insulation. The vacuum container is designed to withstand external pressure forces, but has a low dead weight. In addition, the vacuum container includes five sides of the transport container. This ensures stability without the need for additional structural components. Even if the vacuum container is damaged, e.g. by external influences, the stability of the transport container is maintained. The materials used for the exterior and interior walls are preferably highly ductile and can exhibit high plastic deformation before they fail. First, both sides of the vacuum chamber would be fully compressed before the walls failed. Although the weight of the vacuum insulation at 3 to 16 kg/m$^2$ (depending on the design and choice of material) is somewhat higher than that of vacuum panels at around 4 kg/m$^2$, the resulting total weight of the transport container is significantly lower.

The invention claimed is:

1. A transport container for transporting temperature-sensitive goods, comprising:

a container wall arrangement surrounding an interior space for receiving the goods and having a plurality of walls adjoining one another at an angle, the container wall arrangement being self-supporting and having an opening for loading and unloading the interior space, the opening can be closed by a separate wall element;

wherein the container wall arrangement encloses the interior space on all sides except the opening;

wherein the container wall arrangement comprises an outer wall, an inner wall spaced therefrom and a vacuum chamber formed between the outer and inner walls;

wherein the vacuum chamber is formed as a continuous vacuum chamber surrounding the interior space on all sides except the opening;

wherein a plurality of insulation foils lying one above the other at a distance are arranged in the vacuum chamber, a foil plane of the foils extending substantially parallel to a plane of the outer and inner walls;

wherein the insulation foils are held at a distance from one another by flat spacer elements, the flat spacer elements being formed by a textile sheet material; and wherein the outer wall and the inner wall are connected by a plurality of spacers, the spacers comprising a cylindrical shape having two smaller diameter cylinders concentrically positioned on each end of the cylindrical shape, the axis of the cylindrical shape being perpendicular to the outer wall and the inner wall.

2. The transport container according to claim 1, wherein the plurality of spacers have a thermal conductivity of <2 W/(m·K).

3. The transport container according to claim 2, wherein the spacers contact the outer and inner walls via at least one pressure distribution element.

4. The transport container according to claim 3, wherein the at least one pressure distribution element is formed as a support plate.

5. The transport container according to claim 3, wherein the at least one pressure distribution element is formed by a widened end of the spacer.

6. The transport container according to claim 1, wherein the insulation foils are formed as metal-vaporized plastic foils.

7. The transport container according to claim 1, wherein the outer and inner walls are made of a metal sheet.

8. The transport container according to claim 1, wherein the vacuum chamber is closed by a connecting collar extending along an edge of the opening and connected to the outer and inner walls.

9. The transport container according to claim 8, wherein the connecting collar extends obliquely relative to the plane of the outer wall.

10. The transport container according to claim 8, wherein the connecting collar has a corrugated or kinked course from the outer to the inner wall.

11. The transport container according to claim 10, wherein:

the kinked course comprises a U-shape; and a thermal insulation is introduced into the recess created by the U-shape.

12. The transport container according to claim 8, wherein the connecting collar is made of the same material as the inner and outer walls.

13. The transport container according to claim 8, wherein the connecting collar is made of a different metal than the inner and outer walls and is welded to the same.

14. The transport container according to claim 1, wherein the transport container further comprises a separate wall element with which the opening is closed.

15. The transport container according to claim 14, wherein a layer of a phase change material is arranged on a side of the separate wall element facing the interior space, which layer extends at least along the edge region of the opening.

16. The transport container according to claim 15, wherein the phase change material covers the entire surface of the separate wall element facing the interior space and an energy distribution layer made of a material with a thermal conductivity of >100 W/(m·K) is arranged between the separate wall element and the phase change material.

17. The transport container according to claim 16, wherein the at least one energy distribution layer consists at least partially of aluminum, copper or carbon nanotubes.

18. The transport container according to claim 15, wherein a further layer of the phase change material is arranged on a side of the inner wall of the container wall arrangement facing the interior space, which layer surrounds the interior space on all sides with an exception of the opening.

19. The transport container according to claim 1, wherein the air pressure in the vacuum chamber is 0.001-0.1 mbar.

20. The transport container according to claim 1, wherein the outer dimensions of the transport container are at least $0.4\times0.4\times0.4\ m^3$.

21. The transport container according to claim 1, wherein a normal distance between the outer and inner walls is 10-40 mm.

* * * * *